US008798512B2

(12) United States Patent
Okamoto et al.

(10) Patent No.: US 8,798,512 B2
(45) Date of Patent: Aug. 5, 2014

(54) APPARATUS AND METHODS FOR ELECTROSTATICALLY PRODUCING DYE-PRINTED MATERIAL

(75) Inventors: Kazumi Okamoto, Osaka (JP); Tadashi Hayami, Kyoto (JP)

(73) Assignees: Nagase & Co., Ltd., Osaka (JP); Kyoto City, Kyoto (JP); Hayami, Tadashi, Kyoto (JP)

( * ) Notice: Subject to any disclaimer, the term of this patent is extended or adjusted under 35 U.S.C. 154(b) by 162 days.

(21) Appl. No.: 13/140,315

(22) PCT Filed: Dec. 16, 2009

(86) PCT No.: PCT/JP2009/070981

§ 371 (c)(1),
(2), (4) Date: Jul. 14, 2011

(87) PCT Pub. No.: WO2010/071154

PCT Pub. Date: Jun. 24, 2010

(65) Prior Publication Data

US 2011/0262192 A1 Oct. 27, 2011

(30) Foreign Application Priority Data

Dec. 16, 2008 (JP) ..... 2008-319425

(51) Int. Cl.
*G03G 15/20* (2006.01)

(52) U.S. Cl.
USPC ..... 399/314; 399/310

(58) Field of Classification Search
USPC ..... 399/341, 314, 310
See application file for complete search history.

(56) References Cited

U.S. PATENT DOCUMENTS

| | | | | |
|---|---|---|---|---|
| 4,085,057 | A | 4/1978 | Masuda et al. | |
| 4,117,498 | A | 9/1978 | Edwards et al. | |
| 4,323,904 | A * | 4/1982 | Edwards et al. | 346/74.7 |
| 2004/0232377 | A1 * | 11/2004 | Nigam | 252/8.61 |

FOREIGN PATENT DOCUMENTS

| | | | |
|---|---|---|---|
| GB | 1025033 | A | 4/1966 |
| JP | S50147721 | A | 11/1975 |
| JP | 51056313 | A | 5/1976 |
| JP | S5197434 | A | 8/1976 |

(Continued)

OTHER PUBLICATIONS

International Search Report issued in PCT/JP2009/070981, mailed on Feb. 9, 2010, 2 pages.

(Continued)

*Primary Examiner* — Billy Lactaoen
(74) *Attorney, Agent, or Firm* — Osha Liang LLP

(57) ABSTRACT

A method for producing a printed material, a method for producing a dye-printed material, a printing apparatus, and a dye-printing system have a good transfer property when a dry toner including a dye is electrostatically transferred to a base material, such as a fabric, based on an electrophotographic system or the like. The methods include a step of providing at least one type of dry toner containing a dye component and a binder resin to a charged body, a step of transferring the dry toner from the charged body to a base material, and a step of fixing the dry toner on the base material. In the transfer step, an electric field is applied between the charged body and the base material to fly the dry toner on the charged body from the charged body to the base material.

14 Claims, 11 Drawing Sheets

(56) References Cited

FOREIGN PATENT DOCUMENTS

| | | | | | |
|---|---|---|---|---|---|
| JP | S5218985 | A | | 2/1977 | |
| JP | 52148135 | A | | 12/1977 | |
| JP | 53081783 | A | | 7/1978 | |
| JP | 05027474 | A | * | 2/1993 | ..... G03G 9/08 |
| JP | 05033275 | A | | 2/1993 | |
| JP | 07278482 | A | | 10/1995 | |
| JP | 08166709 | A | * | 6/1996 | ..... G03G 15/05 |
| JP | 08226083 | A | | 9/1996 | |
| JP | 09073198 | A | | 3/1997 | |
| JP | 09146290 | A | | 6/1997 | |
| JP | 10035001 | A | * | 2/1998 | ..... B41J 2/385 |
| JP | 10195776 | A | | 7/1998 | |
| JP | 10239916 | A | | 9/1998 | |
| JP | 11043874 | A | | 2/1999 | |
| JP | 11279959 | A | | 10/1999 | |
| JP | 2995135 | B2 | | 12/1999 | |
| JP | 2001271279 | A | | 10/2001 | |
| JP | 2003096340 | A | | 4/2003 | |
| JP | 2003248335 | A | | 9/2003 | |
| JP | 2008101299 | A | | 5/2008 | |
| JP | 2008102314 | A | | 5/2008 | |

OTHER PUBLICATIONS

Written Opinion issued in PCT/JP2009/070981, mailed on Feb. 9, 2010, 4 pages.
International Preliminary Report on Patentability issued in PCT/JP2009/070981, dated Jul. 14, 2011, 3 pages.
International Search Report issued in PCT/JP2009/070980, mailed on Feb. 9, 2010, 2 pages.
Written Opinion issued in PCT/JP2009/070980, mailed on Feb. 9, 2010, 3 pages.
International Preliminary Report on Patentability issued in PCT/JP2009/070980, dated Jul. 14, 2011, 3 pages.
Espacenet Patent Abstract, Application No. JP 2008101299, dated May 1, 2008, 1 page.
Espacenet Patent Abstract, Application No. JP 11279959, dated Oct. 12, 1999, 1 page.
Espacenet Patent Abstract, Application No. JP 11043874, dated Feb. 16, 1999, 1 page.
Espacenet Patent Abstract, Application No. JP 52148135, dated Dec. 9, 1977, 1 page.
European Search Report issued in EP Application No. 09833456.8, mailed Aug. 2, 2012, (8 pages).
Thomson Scientific, "Database WPI Week 200859," AN 2008-K00946, XP002680493, May 1, 2008 (2 pages).
Patent Abstracts of Japan for Japanese Publication No. 2008-102314, publication date May 1, 2008 (1 page).
Chinese Office Action issued in Chinese Application No. 200980150444.0 mailed on Aug. 3, 2012 and a partial English translation thereof, 9 pages.
Office Action issued in corresponding Japanese Application No. 2010-542988 dated May 7, 2013, and English translation thereof (5 pages).
English abstract of Japanese Publication No. S51-97434 published on Aug. 27, 1976, Espacenet database, 1 page.
Partial translation of Japanese Publication No. S52-18985 published on Feb. 12, 1977, 2 pages.
Partial translation of Japanese Publication No. S50-147721 published on Nov. 27, 1975, 3 pages.

* cited by examiner

APPARATUS AND METHODS FOR ELECTROSTATICALLY PRODUCING DYE-PRINTED MATERIAL

TECHNICAL FIELD

The present invention relates to a method for producing a printed material, a method for producing a dye-printed material, a printing apparatus, and a dye-printing system.

BACKGROUND ART

Dye-printing is applied to textile products of various forms, such as yarns, knit fabrics, and secondary products, and to other materials. As shown in Patent Literatures 1 to 8, various dye-printing techniques are known.

Patent Literature 1: Japanese Patent Laid-Open No. 10-195776

Patent Literature 2: Japanese Patent No. 2995135

Patent Literature 3: Japanese Patent Laid-Open No. 2003-96340

Patent Literature 4: Japanese Patent Laid-Open No. 7-278482

Patent Literature 5: Japanese Patent Laid-Open No. 8-226083

Patent Literature 6: Japanese Patent Laid-Open No. 9-73198

Patent Literature 7: Japanese Patent Laid-Open No. 10-239916

Patent Literature 8: Japanese Patent Laid-Open No. 5-027474

Patent Literature 9: Japanese Patent Laid-Open No. 5-033275

By the way, among the dye-printing methods using an electrophotographic system, a property of transfer from a photoreceptor to a base material, such as a fabric, is poor in methods using a liquid toner (for example, Patent Literatures 5 and 6). For example, in a base material, such as a fabric, with projections and recesses on the surface due to weave pattern, mesh, embossing, or the like for design, although the toner is actively transferred to the projected sections, it is difficult to transfer the toner to the recessed sections, and the clarity tends to be insufficient.

Meanwhile, dye-printing techniques adopting an electrophotographic system using a dry toner instead of the liquid toner are also developed (Patent Literatures 7 and 8). However, in the methods of Patent Literatures 7 and 8, for example, although the toner is actively transferred to the projected sections in a base material, such as a fabric, with projected and recessed sections on the surface, it is difficult to transfer the toner to the recessed sections, and the clarity tends to be insufficient. In this way, there are various states in the surface of the base material as a target of dye-printing and printing, and an improvement in the transfer property is demanded.

Therefore, embodiments of the present invention provide a method for producing a printed material, a method for producing a dye-printed material, a printing apparatus, and a dye-printing system with a good transfer property when a dry toner including a dye is electrostatically transferred to a base material, such as a fabric, based on an electrophotographic system or the like.

SUMMARY OF INVENTION

A method for producing a printed (fixed material) material according to one or more embodiments of the present invention includes: a step of electrostatically providing at least one type of dry toner containing a dye component and a binder resin to a charged body;

a step of transferring the dry toner from the charged body to a base material; and a step of fixing the dry toner to the base material. In the transferring step, the dry toner on the charged body is flown from the charged body to the base material by applying an electric field between the charged body and the base material.

A printing apparatus (fixing apparatus) according to one or more embodiments of the present invention includes:

a base material conveying unit that conveys a base material;

an electrostatic holding unit that electrostatically holds, on a charged body, at least one type of dry toner containing a dye component and a binder resin;

a transfer unit that transfers the dry toner held on the charged body to the base material conveyed by the base material conveying unit; and a fixing unit that is arranged on the downstream of the transfer unit on the base material conveying unit and that fixes the transferred dry toner to the base material. The transfer unit includes an electric field application unit that applies an electric field between the base material on the base material conveying unit and the charged body for flying the dry toner on the charged body from the charged body to the base material.

According to one or more embodiments of the present invention, the dry toner is transferred by flying. Therefore, a high transfer property of the dry toner can be realized regardless of the state of the surface of the base material, and a clear image can be printed (fixed).

According to one or more embodiments of the present invention, the surface of the base material has projections and recesses, and even in that case, the high transfer property can be attained.

According to one or more embodiments of the present invention, the base material is a fabric. The surface of the fabric has complicated projections and recesses, such as gaps between fibers and grooves between strings. Even in that case, a clear transfer is possible.

According to one or more embodiments of the present invention, in the transferring step, the dry toner is arranged between fibers constituting the fabric.

According to one or more embodiments of the present invention, in the transferring step, the electric field is applied in a state in which a space is provided between the dry toner on the charged body and the base material or in a state in which the charged body does not press the dry toner against the base material.

According to one or more embodiments of the present invention, the transfer unit has a space between the dry toner on the charged body and the base material, or a charged body of the transfer unit does not press the dry toner on the charged body against the base material.

As a result of these, for example, disproportionate application of the dry toner to a most-projected section or the like of the base material can be prevented, and a good image with little density unevenness can be reproduced on the base material.

According to one or more embodiments of the present invention, the gap between the fibers constituting the fabric provided in the transferring step is filled with an inorganic filler.

In that case, penetration of the dry toner through the fabric can be prevented, and stains of the belt and the waste of the dry toner can be prevented.

According to one or more embodiments of the present invention, the charged body is a conductive photoreceptor, and in the providing step, an image based on the dry toner is provided to the conductive photoreceptor.

According to this, images of various shapes can be easily formed by the toner.

According to one or more embodiments of the present invention, in the fixing step, the dry toner is provisionally fixed to the base material. According to one or more embodiments of the present invention, the fixing unit provisionally fixes the transferred dry toner to the base material.

As a result, the binder can be easily removed in a subsequent step, and a base material, such as a fabric, with a good handle can be obtained.

A printed material according to one or more embodiments of the present invention is a printed material produced by the method described above.

A method for producing a dye-printed material according to one or more embodiments of the present invention includes: the method for producing a printed material described above; and a step of dyeing the base material by the dye component in the fixed dry toner in the printed material.

A dye-printing system according to one or more embodiments of the present invention includes: the printing apparatus described above; and a dye unit that is arranged on the downstream of the printing apparatus and that dyes the base material discharged from the printing apparatus by the dye component in the dry toner fixed to the base material.

According to one or more embodiments of the present invention, a dye-printed material including an image clearly dyed on the base material can be obtained.

The dye-printed material according to one or more embodiments of the present invention is a dye-printed material produced by the method described above.

According to one or more embodiments of the present invention, a clear printed material and a dye-printed material with a high transfer property of image can be obtained regardless of the state of the surface of a base material.

DETAILED DESCRIPTION OF INVENTION

Although embodiments of the present invention will be described with reference to the drawings, the present invention is not limited to the following embodiments.

First Embodiment

Figure 1:
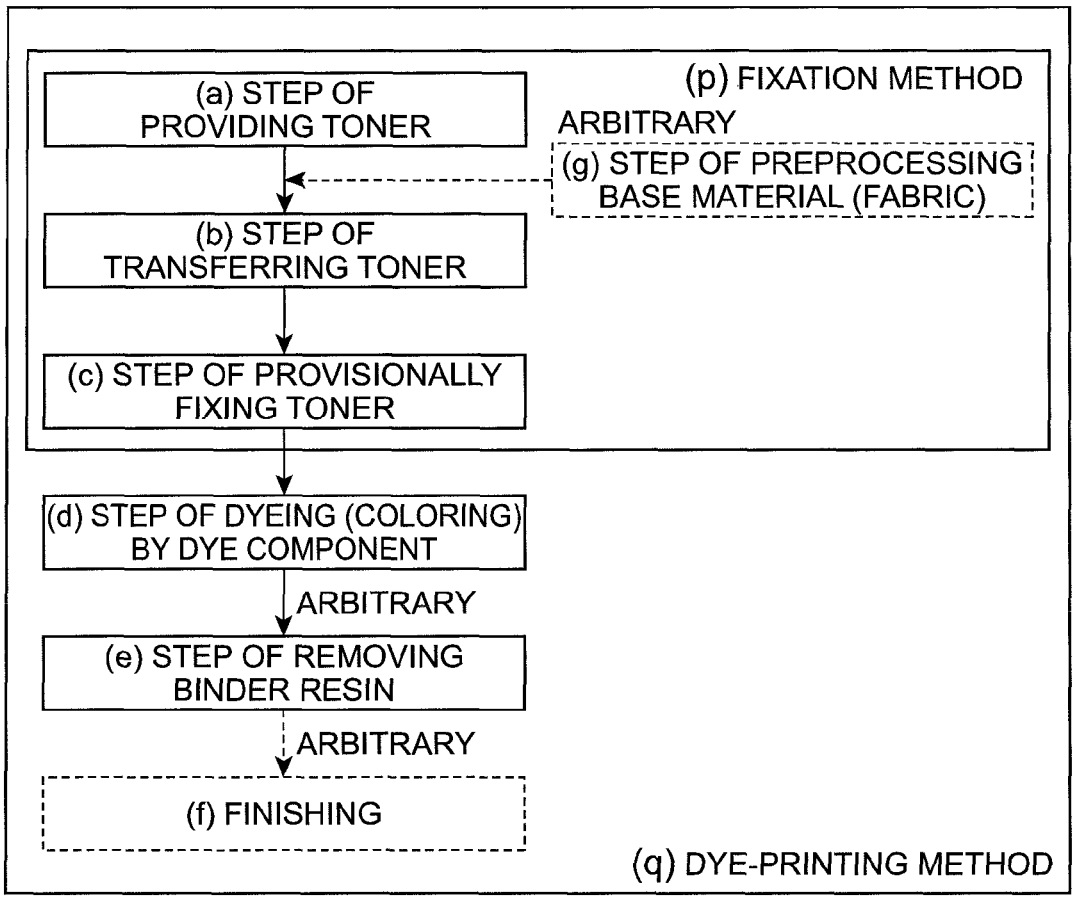
FIG. 1 is a flow chart of a method for producing a printed material and a method for producing a dye-printed material according to a first embodiment of the present invention.

FIG. 1 is a diagram schematically showing a process chart for explaining an example of working steps for carrying out a method (p) for producing a printed material and a method (q) for producing a dye-printed material according to the embodiments of the present invention.

As shown in FIG. 1, in the present embodiment, the method (p) for producing a printed material includes a step (a) of electrostatically providing dry toner particles to a charged body, a step (b) of electrostatically transferring a dry toner from the charged body to a base material, and a step (c) of provisionally fixing the dry toner particles transferred to the base material to the base material. As a result, a base material including the toner particles fixed to the base material (hereinafter, may be called "printed material" (fixed material)) can be obtained. In addition, the method (q) for producing a dye-printed material in the present embodiment further includes a step (d) of dyeing the base material by a dye component in the provisionally fixed dry toner particles, a step (e) of removing a binder resin of the provisionally fixed dry toner particles from the base material after the dye step (d) if necessary, and a finishing step (f) executed if necessary. As a result, a base material that is colored by a dye component in the toner particles (hereinafter, "dye-printed material") can be obtained.

If necessary, a predetermined processing step (g) for reducing or smoothing a projected and recessed state of the surface of a base material as a target of printing and dye-printing can be performed.

Next, details of the methods for producing a printed material and a dye-printed material will be described in detail along with a printing apparatus and a dye-printing system used in the methods.

Figure 2:
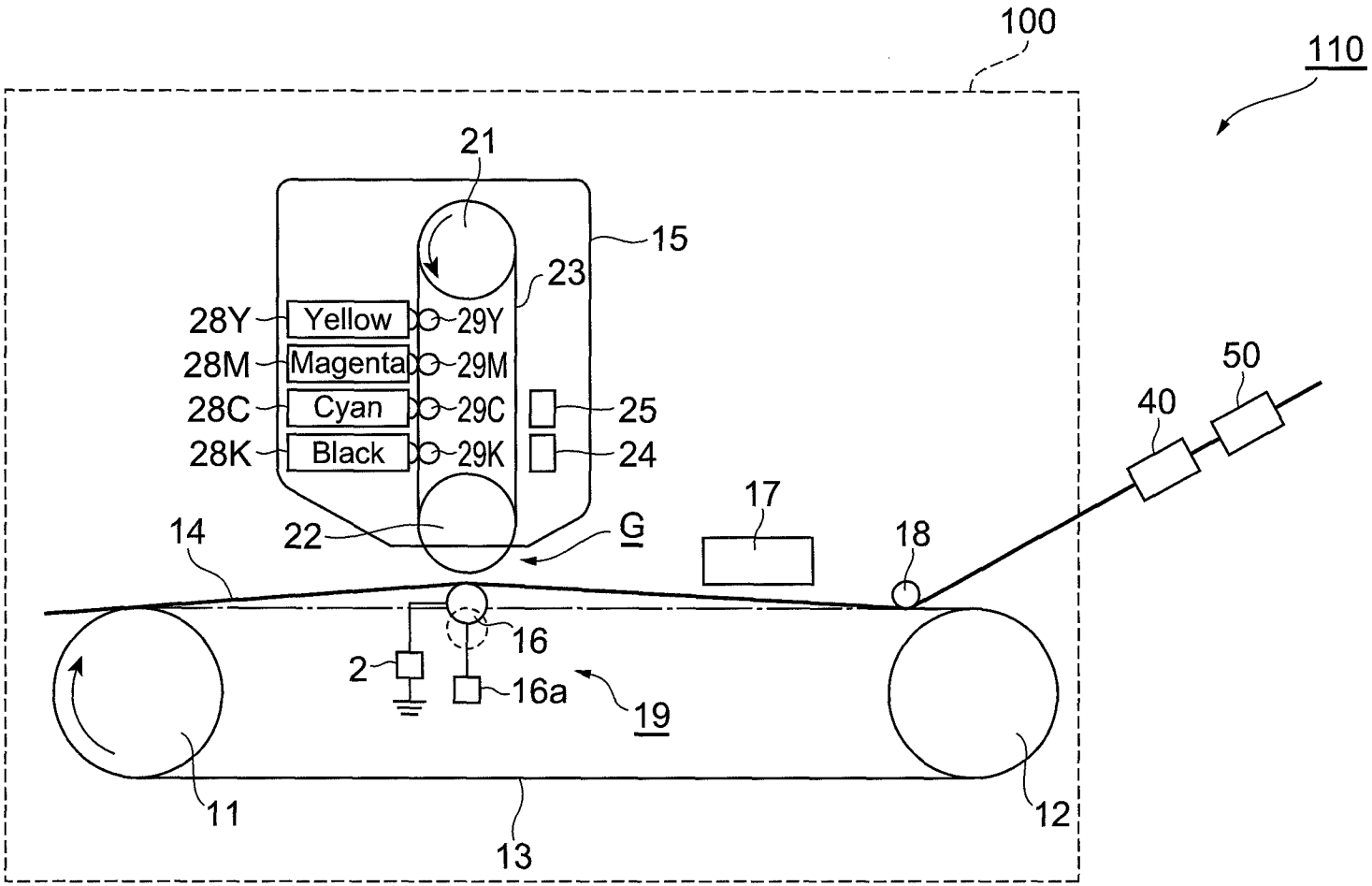
FIG. 2 is a schematic diagram showing a printing apparatus and a dye-printing system according to the first embodiment of the present invention.

FIG. 2 is a schematic diagram showing a printing apparatus 100 and a dye-printing system 110 for carrying out the methods for producing a printed material and a dye-printed material according to an embodiment of the present invention. The printing apparatus 100 of FIG. 2 performs dye-printing based on a four-color collective transfer system. As shown in FIG. 2, the printing apparatus includes two pulleys 11 and 12 and a conveying belt 13 wound between the pulleys, and a drive apparatus (not shown) drives one of the two pulleys 11 and 12. An adhesive used in a conventional dye processing field is applied on the conveying belt 13, and the adhesive fixes a base material 14 to the conveying belt 13. In the apparatus 100 of FIG. 1, the base material 14 moves from the pulley 11 to the pulley 12. In the present embodiment, the conveying belt 13 forms a base material conveying unit.

The printing apparatus 100 also includes a four-color imaging unit (electrostatic holding unit) 15 that forms an image formed by dry toner particles for transfer to the base material 14. The four-color imaging unit 15 includes pulleys 21 and 22 arranged above and below and an intermediate transfer belt (charged body) 23 wound between the pulleys. Between the pulleys 21 and 22, on the intermediate transfer belt 23, the four-color imaging unit 15 includes a cleaning apparatus 24 that removes an attachment on the intermediate transfer belt 23 and an electricity removal apparatus 25 arranged as necessary to remove electricity of the intermediate transfer belt 23. Four monochromatic imaging units 28Y, 28M, 28C, and 28K of yellow, magenta, cyan, and black are arranged side by side in the belt movement direction, the units facing the surface of the intermediate transfer belt 23. On the rearside across the intermediate transfer belt 23 of the four monochromatic imaging units 28Y, 28M, 28C, and 28K, primary transfer rollers 29Y, 29M, 29C, and 29K corresponding to the colors are arranged, respectively. Each of the monochromatic imaging units 28Y, 28M, 28C, and 28K includes an individual photoreceptor belt within the unit, and along the travelling direction of the belt and around the unit, includes an electricity removal apparatus, a charging apparatus, an exposure apparatus, a development apparatus, and a cleaning apparatus (not shown) in this order. The monochromatic imaging units 28Y, 28M, 28C, and 28K as well as the primary transfer rollers 29Y, 29M, 29C, and 29K can electrostatically transfer monochromatic images formed by the toner particles on the photoreceptor belt to the intermediate transfer belt, and arbitrary full-color images can be continuously formed on the intermediate transfer belt 23.

Figure 3:
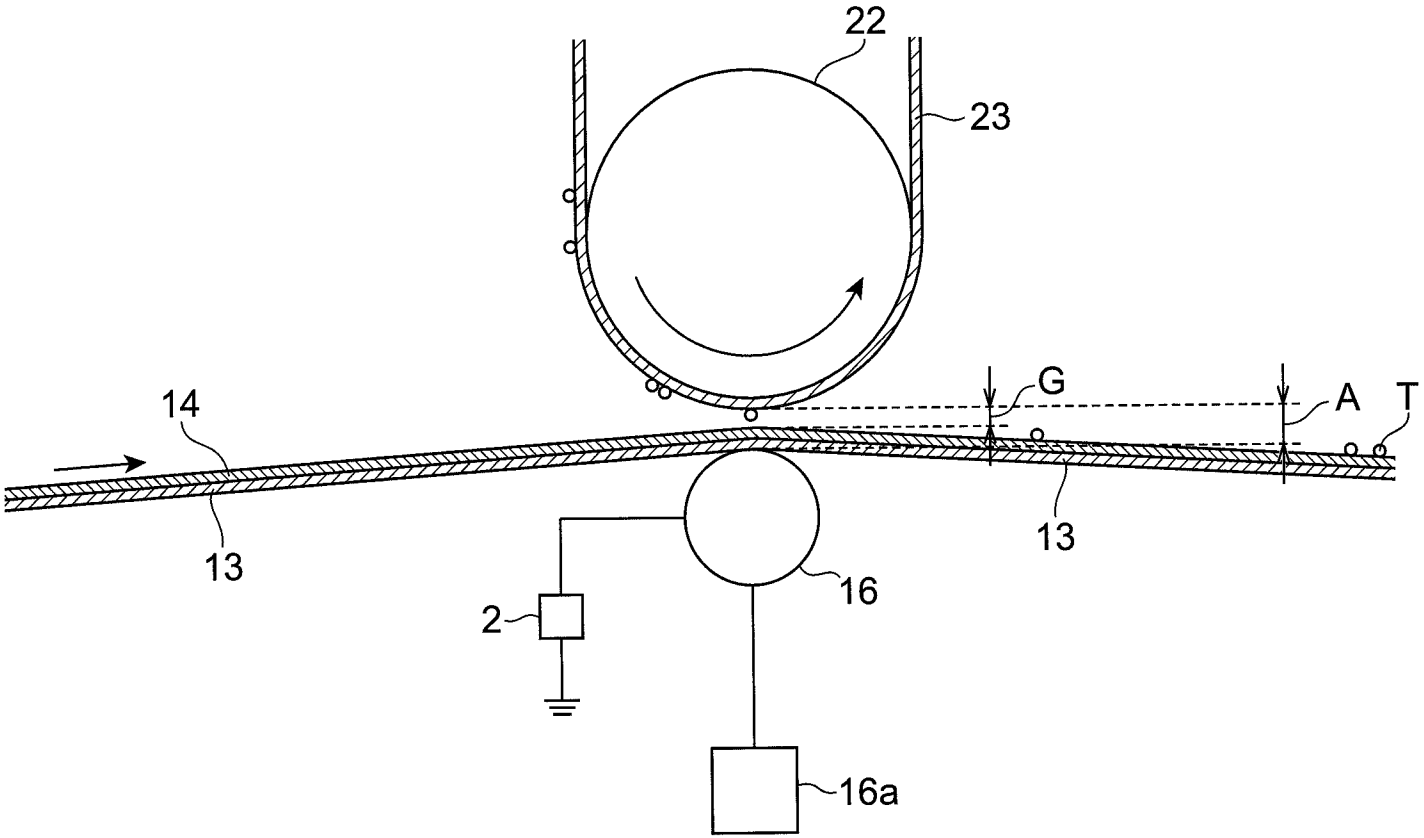
FIG. 3 is an enlarged schematic diagram between a pulley 22 and a secondary transfer roller 16 of the printing apparatus of FIG. 2.

Below the four-color imaging unit 15, a secondary transfer roller 16 is arranged through the conveying belt 13 and the base material 14. A high-voltage power supply 2 supplies, to the secondary transfer roller 16, a high voltage with a sign opposite the dry toner particles electrostatically held on the intermediate transfer belt 23. As a result, as shown in FIG. 3, a strong electric field is generated in a transfer gap G between a toner T on the intermediate transfer belt 23 and the base material 14. The dry toner particles T on the intermediate transfer belt 23 fly from the intermediate transfer belt 23 to the base material 14 due to the electrostatic force, and the image formed by the dry toner on the intermediate transfer belt 23 is transferred to the base material 14. In the secondary transfer roller 16, a transfer gap adjustment apparatus 16*a* can adjust the transfer gap G between the base material 14 on the conveying belt 13 and the dry toner T on the transfer belt 23. The transfer gap G can be easily obtained by subtracting the thicknesses of the conveying belt 13 and the base material 14 from the distance between the intermediate transfer belt 23 and the secondary transfer roller 16. In the present embodiment, the secondary transfer roller 16, the transfer gap adjustment apparatus 16*a*, and the high-voltage supply 2 form a transfer unit 19, and the high-voltage power supply 2 forms an electric field application unit. The implementation is possible even if there is no transfer gap adjustment apparatus 16*a* and the transfer gap is fixed.

On the downstream of the secondary transfer roller 16 on the conveying belt 13, a fixation apparatus (fixing unit) 17 that provisionally fixes an image on the base material 14 is arranged. In the present embodiment, the fixation apparatus 17 fixes the dry toner to the base material 14 to an extent that allows removing the binder component in the dry toner after dyeing. The fixation apparatus 17 can be constituted by, for example, noncontact heating means for softening the dry toner without contacting the base material 14 or a solvent spray apparatus (spray unit) that sprays a solvent containing a solvent with a swelling effect for the binder resin included in the dry toner, or can be constituted by a combination of the means and the apparatus. Examples of the noncontact heating means include heaters such as infrared heaters including an infrared ceramic heater and an infrared lamp, a hot-air heater and a hot plate. Examples of the solvent include ethyl alcohol, methyl alcohol, isopropyl alcohol, diethyl ether, ethyl acetate, and mixed solvents thereof. The configuration of the solvent spray apparatus are not particularly limited, and various known apparatuses can be used.

Furthermore, on the downstream of the fixation apparatus 17 on the conveying belt 13, a peeling roller 18 for peeling off the base material 14 from the conveying belt 13 is provided.

On the downstream of the printing apparatus 100 configured this way, a dye apparatus (dye unit) 40 and a binder removal apparatus (binder removal unit) 50 are further arranged, and the components as a whole form the dye-printing system 110.

Specifically, the dye apparatus (dye unit) 40 is an apparatus that is arranged on the rearside of the peeling roller 18 and that dyes the base material by the dye component included in the provisionally fixed dry toner, and for example, the dye apparatus 40 performs a superheated steam treatment. The binder removal apparatus (binder removal unit) 50 removes the binder resin from the base material after dyeing, and for example, performs an alkaline treatment.

The dye apparatus 40 and the binder removal apparatus 50 may be continuously arranged on the downstream of the peeling roller 18 as shown in FIG. 2 or may be arranged non-continuously (for example, the base material 14 is temporarily rolled up after passing through the peeling roller 13, and the dyeing and the removal are performed at another location).

(Base Material)

The base material used in one or more embodiments of the present invention is a material that has an electric insulation property and that can be dyed. The material is smooth or has projections and recesses on the surface, and the examples of the material include fabric, paper, plastic film, and plastic sheet. Particularly, a base material having projections and recesses on the surface is preferable. The plastic film, the plastic sheet, or the like may have projections and recesses formed by embossing or the like. Although the extent of the projections and recesses is not particularly limited, the ratio of the minimum thickness to the maximum thickness may be 50% or less or may be, for example, 0% as in a mesh fabric.

Examples of the fabric that can be used in one or more embodiments of the present invention include natural or artificial knit, woven fabric, and nonwoven fabric. According to one or more embodiments of the present invention, the fabric includes, other than the ones described above, materials that can be recognized as fiber structures in general, such as a braid including strings or ropes, a flocculent high-bulk rayon staple, a sliver, a porous sponge, and a felt.

Although not particularly limited, the fabric targeted in one or more embodiments of the present invention is produced from one of or a combination of two or more types of natural fibers, such as cotton, kapok, hemp, silk, wool, camel, mohair, cashmere, alpaca, and Angora, synthetic fibers, such as polyamide fibers, polyaramide fibers, polyester fibers, polytrimethylene terephthalate (PTT) fibers, polybutylene terephthalate (PBT) fibers, polyacrylate fibers, polylactic acid fibers (PLA fibers), polyvinyl alcohol (PVA) fibers, polyvinyl chloride-based fibers, polyethylene-based fibers, polyurethane-based fibers, polyacrylic-based fibers, polypropylene(PP)-based fibers, polyphenylene sulfide (PPS) fibers, benzoate-based fibers, polystyrene-based fibers, polytetrafluoroethylene-based fibers, polyvinylidene cyanide-based fibers, polyether-ester-based fibers, and promix fibers, semisynthetic fibers, such as diacetate fibers, triacetate fibers, and nitrocellulose fibers, regenerated fibers, such as rayon, cupra, soybean protein fibers, and milk protein fibers, and inorganic fibers, such as glass fibers, basalt fibers, wollastonite, silica-alumina fibers, zirconia fibers, boron fibers, boron nitride fibers, and silicon nitride titanium calcium fibers.

Yarns that may form the fabric in one or more embodiments of the present invention include, but are not particularly limited to, monofilaments, multifilaments, staple fibers (rayon staples), tow, high-bulk rayon staples, high-bulk tow, spun yarns, blended yarns, textured yarns, temporary twisting yarns, modified cross-section yarns, hollow yarns, conjugated yarns, POY (partially oriented yarns), DTY (draw-textured yarns), POY-DTY, and slivers.

The thickness of the fabric used in one or more embodiments of the present invention is not necessarily limited as long as the fabric can pass through a gap set between a photoreceptor belt and a secondary transfer roller described later.

(Dry Toner)

The dry toner used in one or more embodiments of the present invention includes a dye component and a binder resin.

Examples of the dye component used for the dry toner include disperse dyes and oil-soluble dyes. In commercially available powder disperse dyes among the disperse dyes, the purity of the dye component may be 30 to 50% by weight based on the weight of the entire disperse dye, and a large amount of other components, such as salt and mirabilite, may be included. As per the dry toner that may be used in one or more embodiments of the present invention, it is preferable to use a disperse dye previously prepared by removing the other components from the disperse dye so that the purity of the dye component is not less than 80% by weight based on the weight of the entire disperse dye after the removal of the other components or to use a disperse dye made of only the dye component. Those skilled in the art can arbitrarily set the content of the dye component in the dry toner used in one or more embodiments of the present invention based on the weight of the toner.

Although not particularly limited, an example of the binder resin used in the dry toner includes a resin component known as an alkali-soluble resin and a water-soluble resin. More specific examples of the binder resin include a water-soluble melamine resin, a water-soluble rosin modified resin, a water-soluble polyester resin, a water-soluble acrylic resin, a water-soluble epoxy resin, polyvinyl alcohol, polyvinyl pyrrolidone, polyethylenimine, carboxymethyl cellulose, sodium alginate, collagen, gelatin, starch, chitosan, and combinations thereof. In the dry toner that may be used in one or more embodiments of the present invention, the content of the binder resins is, for example, 75% to 90% by weight based on the weight of the dry toner.

The dry toner may contain other components, such as a charge control agent and a wax. The wax is used to prevent the offset to the photoreceptor belt or the like described later. When the charge control agent is mixed, a preferable amount of mixture is, for example, 0.2 to 1% by weight based on the weight of the toner. When the wax is mixed, a preferable amount of mixture is, for example, 0.1 to 5% by weight based on the weight of the toner.

Specifically, the dry toner used in the present embodiment can be prepared, for example, as follows. An example of a cyan dry toner will be described here. A water-soluble polyester resin (87.56% by weight), a wax (4.61% by weight), a charge control agent for negative charge (0.46% by weight), and a dye component (7.37% by weight; color index disperse blue 60) are mixed and kneaded at a temperature of 50° C. After the mixture is cooled, the mixture is roughly ground to about ϕ2 μm at the maximum. Then, the mixture is further finely ground and further classified to obtain powder of particles in a 5.8 to 6.3 μm average particle size. About 1% of fine power of silica or titanium is added to the 100% powder to prevent aggregation, and the cyan dry toner used in the present embodiment is obtained.

The method for producing a dye-printed material using the printing apparatus 100 and the dye-printing system 110 configured as shown in FIG. 2 will be described. Here, a case of applying dye-printing to a fabric including warp yarns and weft yarns as the base material 14 will be described. First, image formation by the four-color imaging unit 15 will be described. The electricity removal apparatus 25 applies an electricity removal process to the intermediate transfer belt 23 from which the cleaning apparatus 24 has removed an attachment. Next, the intermediate transfer belt 23 after the electricity removal is conveyed to the yellow imaging unit 28Y through the pulley 21. The yellow imaging unit 28Y electrostatically attaches a yellow dry toner to the intermediate transfer belt 23. Similarly, the magenta imaging unit 28M electrostatically attaches a magenta dry toner to the intermediate transfer belt 23. The following cyan imaging unit 28C electrostatically attaches a cyan dry toner to the intermediate transfer belt 23, and lastly, the black imaging unit 28B electrostatically attaches a black dry toner to the intermediate transfer belt 23. As a result, an image is ultimately completed on the intermediate transfer belt 23 based on the dry toners of each of the colors.

The image formed on the intermediate transfer belt 23 this way is transferred to the base material 14 conveyed over the conveying belt 13 based on the electric field provided between the secondary transfer roller 16 and the pulley 22 by the high-voltage power supply 2. In that case, as shown in FIG. 3, the secondary transfer roller 16 pushes up the base material 14 and the conveying belt 13 from below, and the secondary transfer roller 16 is stopped at a position where the intermediate transfer belt 23 does not directly press the dry toner T on the intermediate transfer belt 23 against the upper surface of the base material 14, i.e., at a position where the transfer gap G between the upper surface of the base material 14 and the dry toner T is not smaller than 0 mm. At such a position, the upper surface of the base material 14 and the dry toner T on the photoreceptor belt 23 are in an unpressurized contact state or a noncontact state.

Figure 4:
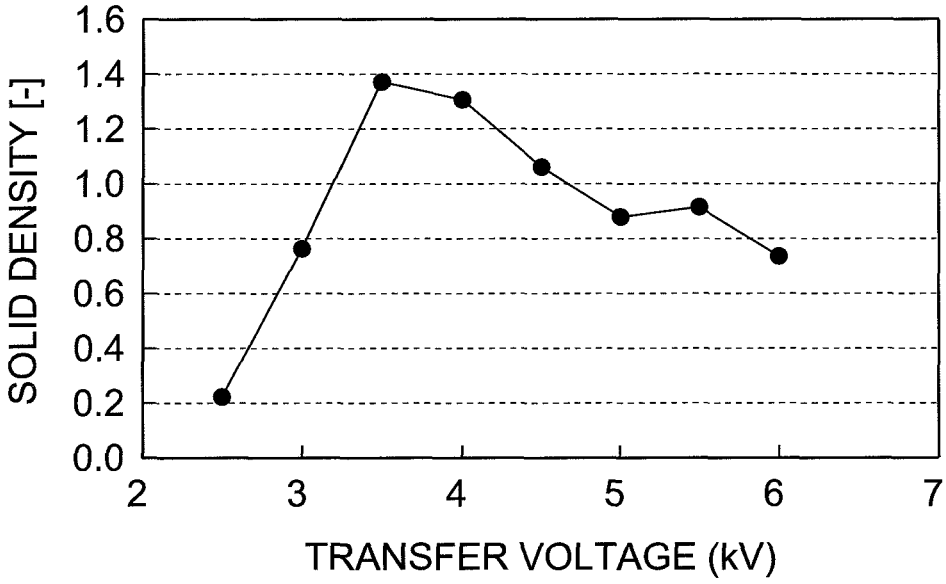
FIG. 4 is a graph showing a change in solid density when a transfer voltage is changed while a transfer gap is fixed at 1.02 mm.

FIG. 4 is an example of measurement of a solid density in solid printing when a transfer voltage based on the high-voltage power supply 2 is changed, while a distance A between the surface of the secondary transfer roller (electrode) 16 and the surface of the intermediate transfer belt 23 is constant at 1.25 mm. The density is a reflection density measured by a reflection densitometer of QEA Inc.

The fabric as the base material 14 used in the experiment is made of polyester satin, and the thickness is 0.13 mm. The thickness of the conveying belt 13 is about 0.1 mm. Because the fabric and the conveying belt 13 exist within the distance A, the transfer gap C, which is a distance between the surface of the fabric 14 and the surface of the intermediate transfer belt 23, is 1.02 mm.

According to FIG. 4, although the solid density increases with the increase in the transfer voltage, the solid density decreases from around 3.5 kV transfer voltage. This indicates that a high transfer voltage is not always good with respect to the distance A, and there is an optimal transfer voltage.

As a result of observation of a solid image with a reduced density at a transfer voltage of 3.5 kV or more in the present example, lightning-shaped white spots are generated, and there is electric discharge because an excessive transfer voltage is applied to the distance A. As a result, it is considered that a normal transfer is not performed, and the density is reduced. It is considered that a similar phenomenon would occur regardless of the size of the distance A.

Figure 5:
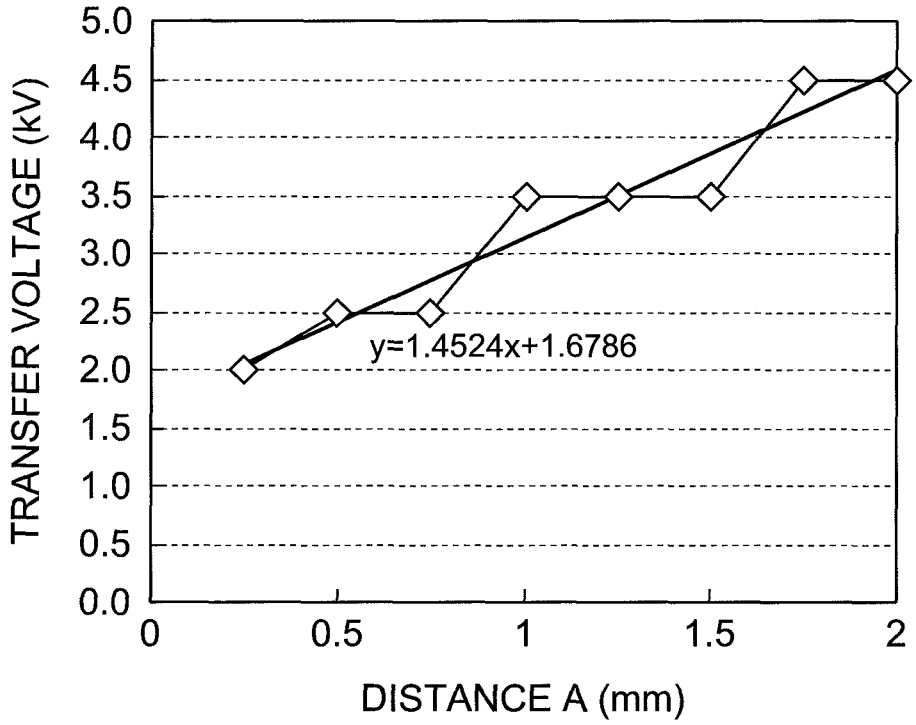
FIG. 5 is a graph showing a relationship between the transfer gap and the transfer voltage that maximizes the solid density.

Based on the forgoing, the distance A between the surface of the secondary transfer roller (electrode) 16 and the surface of the intermediate transfer belt 23 is made variable, and when the transfer voltage that can obtain the maximum density is examined, a result as shown in Table 1 and FIG. 5 is obtained. The maximum density is almost constant at 1.3.

TABLE 1

| | Distance A (mm) | | | | | | | |
|---|---|---|---|---|---|---|---|---|
| | 0.25 | 0.50 | 0.75 | 1.00 | 1.25 | 1.50 | 1.75 | 2.00 |
| Transfer Voltage (kV) | 2.00 | 2.50 | 2.50 | 3.50 | 3.50 | 3.50 | 4.50 | 4.50 |

As shown in FIG. 5, when the distance A is increased, the transfer voltage for obtaining the maximum density almost linearly increases. When an approximation formula is calculated by a first order approximation, $y \cong 1.45x+1.68$ as shown in FIG. 5. Here, y denotes the transfer voltage (kV), and x denotes the distance A (mm).

The transfer is preferably performed at a range of 85% or more, more preferably at 90% or more, and still more preferably at 95% or more relative to the voltage y obtained by the approximation formula relative to the value x of the distance A. The transfer is preferably performed at a condition of a range of 160% or less, more preferably at 140% or less, and still more preferably at 120% or less. The density is reduced when the transfer voltage is too high or too low.

In the transfer of the image formed on the photoreceptor belt 23 to the base material 14, if a pressure is further applied when the distance between the fabric and the image is 0 mm, the toner is selectively transferred to a top section of a weave pattern of the pressurized fabric. As a result, the density is significantly high at the top section, and the image quality tends to be degraded.

Returning to FIG. 2, the base material 14 including the image transferred from the intermediate transfer belt 23 is transmitted to the fixation apparatus 17. An example of the fixation apparatus 17 that can be used includes a noncontact heater, such as an infrared heater (preferably, a far-infrared heater or the like). The role of the fixation apparatus 17 of the present embodiment is to provisionally fix the image transferred to the base material 14 so that the image is not disordered until the transition to the next dye step, and for example, the image does not have to be strongly fixed as when the image is printed on the paper. In dye-printing, it is often important to avoid degrading the handle of the fabric, and in this regard, the binder resin component included in the dry toner becomes an obstacle after dyeing. Therefore, because it is preferable that the component can be easily removed in a binder removal step, such as soaping, after the dye step, it is important to provisionally fix the dry toner in the fixation apparatus 17, instead of completely melting and strongly fixing the dry toner. It is also an important point to avoid disordering the image of the fabric. Therefore, in the apparatus of FIG. 2, a noncontact heater, such as a far-infrared heater, is used as described above to avoid significantly changing the shape of the toner and to heat the toner in a noncontact manner to an extent that adhesion to the fabric is generated.

It is preferable that the heat temperature in the fixation apparatus 17 is equal to or greater than a glass transition temperature Tg and smaller than a melting point Tm of the binder resin included in the dry toner. The surfaces of the dry toner particles heated in a noncontact manner at such a temperature are melted and become adhesive while the original forms are maintained, and the particles are provisionally fixed to the base material such as a fabric. In that case, the dry toner particles do not completely melt and enter between the fibers of the fabric, and therefore, the binder can be easily removed in a subsequent step after the completion of dyeing to the fabric.

Figure 6:
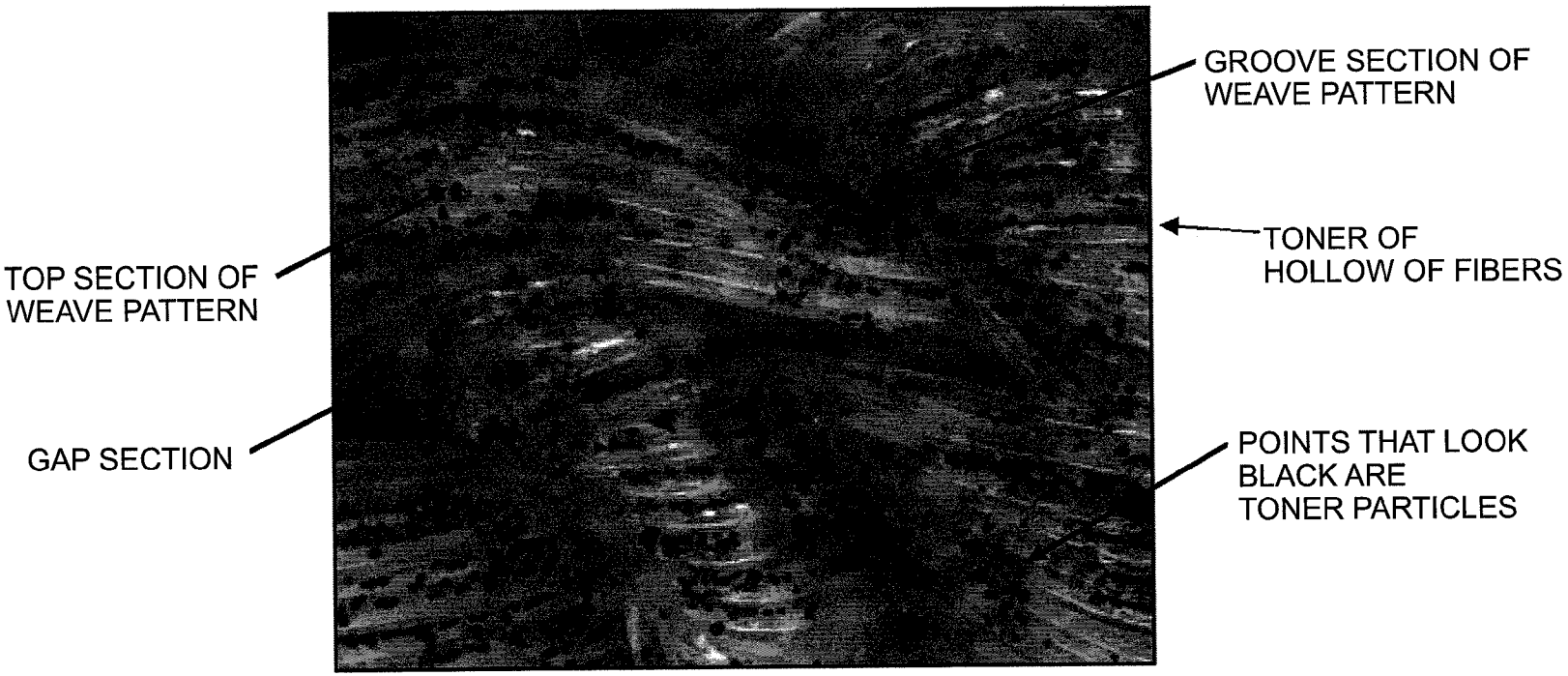
FIG. 6 is a microphotograph of a fabric after a dry toner is provisionally fixed by the method and the apparatus of the first embodiment.
Figure 7:
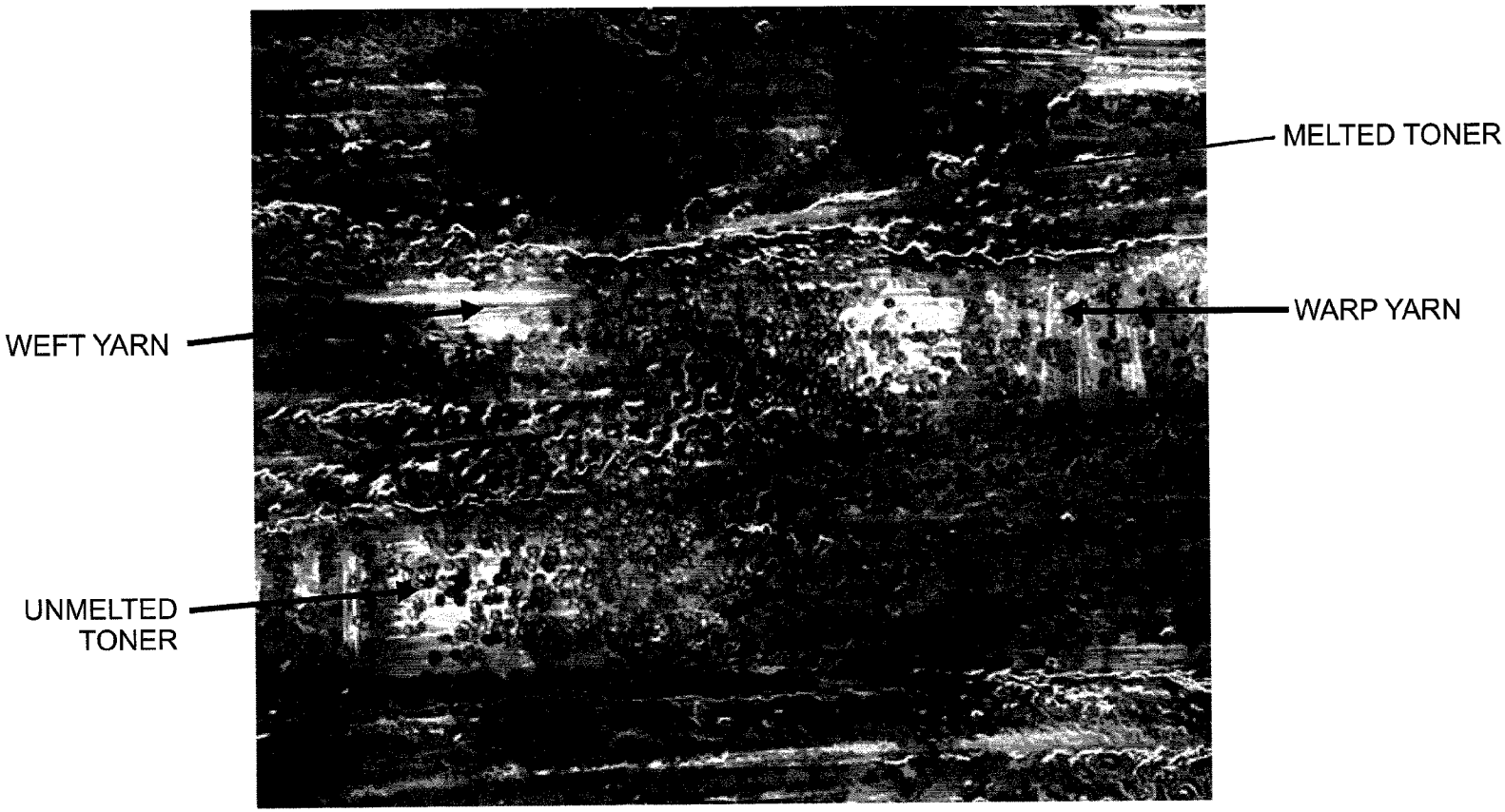
FIG. 7 is a microphotograph of a fabric, in which a dry toner is sufficiently fixed to the fabric by a conventional heating system.

FIG. 6 is a microphotograph of the fabric as the base material 14 after provisionally fixing the dry toner transferred using the value of y by use of a noncontact heater as described below. FIG. 7 is a microphotograph of a fabric that a dry toner is sufficiently fixed to by a conventional heat contact system, i.e., pressing the fabric including the transferred dry toner against a heated roller to heat the fabric.

When FIGS. 6 and 7 are compared, it can be recognized that the dry toner is melted and fixed so as to be filled between the weave patterns of the fabric and between the fibers constituting the yarn in the conventional fixation by heating and pressing of FIG. 7, while the dry toner particles are fixed while maintaining the original forms thereof as shown in FIG. 6 if the provisional fixation is performed as in one or more embodiments of the present invention, and moreover, the dry toner reaches not only the top section of the weave pattern of the fabric, but also the groove section of the weave pattern. This means that the image can be clearly fixed to the base material, such as a fabric, regardless of the projections, recesses, and the like of the fabric, and it can be recognized that according to the methods for producing a printed material and a dye-printed material according to one or more embodiments of the present invention, a more clear image can be formed on the base material such as a fabric.

When FIG. 6 is observed in further details, it can be recognized that the toner is located at a gap between fibers of warp yarns or weft yarns forming the fabric. The toner at such a location is in a state of being wrapped by the fibers when the color is developed, and clearer coloring can be easily obtained after dyeing.

Furthermore, because the toner particles maintain the original forms without melting, the binder resin can be easily removed when the binder resin included in the toner is removed after coloring. On the other hand, in the conventional fixation of FIG. 7, it can be recognized that the binder resin constituting the toner is entwined with the fabric fibers, and the binder resin cannot be easily removed from the fabric. Therefore, according to the conventional fixation, the original handle of the fabric is significantly lost.

Here, in the fixation apparatus 17, to obtain an effect of provisionally fixing the toner, a solvent containing a solvent with a swelling effect relative to the binder resin included in the dry toner can be sprayed instead of heating or in addition to heating. As a result of the solvent spray, the surfaces of the dry toner particles are melted or swelled to become adhesive while maintaining the original forms, and the particles are temporarily fixed on the fabric. Examples of the solvent with a swelling effect that can be used include ethyl alcohol, methyl alcohol, isopropyl alcohol, diethyl ether, ethyl acetate, and mixed solvents thereof.

The fabric, on which the image is provisionally fixed by the fixation apparatus 17, is the printed material.

Subsequently, the base material 14 including the provisionally fixed image based on the dry toner is peeled off from the conveying belt 13 by the peeling roller 18 and transmitted to the following dye apparatus 40. The dye apparatus 40 applies a dye process (such as exposure to superheated steam) to the base material 14 according to the dye in the toner and the base material, and as a result, the fabric is dyed by the dye component included in the provisionally fixed dry toner.

In accordance with the type of the binder, the binder removal apparatus 50 applies a binder removal process (for example, a soaping process, such as washing by alkaline aqueous solution (for example, a caustic soda solution prepared at a predetermined concentration) and washing by water in a bath) to the base material 14 finished with the dye process by the dye apparatus to remove the binder resin left on the base material 14. Further through post-processing such as a finishing step such as hot press, the base material 14 becomes a dye-printed material as a final product. When the binder resin is removed after dyeing, not only the handle improves, but also excellent fastness to rubbing and washing resistance characteristics are attained.

Figure 8:
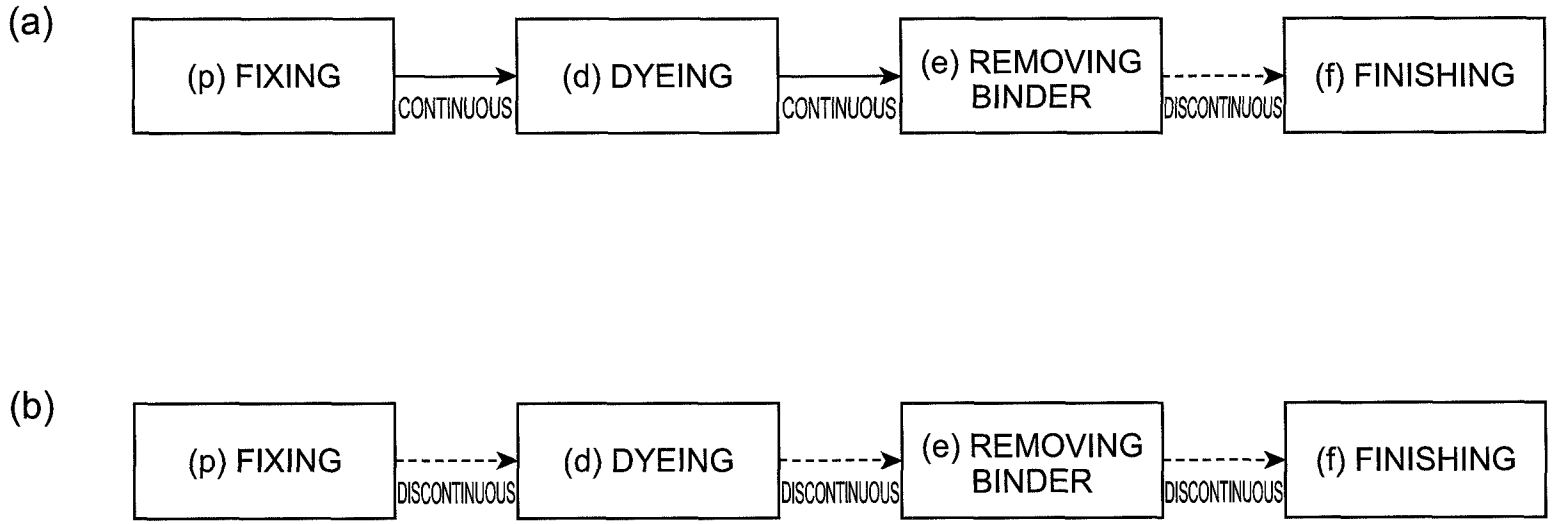
FIGS. 8(*a*) and 8(*b*) are flow charts explaining modified modes of the method and the apparatus, respectively, according to the first embodiment.

As described, according to the present embodiment, the base material, such as a fabric, that an image is provisionally fixed to by the fixing step (p) is subjected to the dye step (d), the binder removal step (e), and the finishing step (f) used in conventional dye-printing, and the dye-printing is completed. However, the steps may be continuous steps as shown in FIG. 8(*a*), or each step may be independent as shown in FIG. 8(*b*).

It is obvious that the arrangement is not limited to this, and only the steps necessary in the configuration of the steps may be continuous or discontinuous.

Although a case in which the gaps existing between the warp yarns and the weft yarns of the fabric are not so large has been described above, if the gaps are relatively large, the proportion of the toner particles penetrating through the spaces of the fabric is large. If much toner is penetrated, the conveying belt 13 is stained by the penetrated dry toner, and much toner is wasted. Therefore, if the gaps are relatively large, it is preferable to apply preprocessing for closing the gaps to the fabric.

The gaps of the fabric significantly change depending on the weave and the type of the yarn, and in general, the proportion of the area of the gap section relative to the entire area of the fabric tends to be large in a fabric using a hard twist yarn. A large proportion of the area of the gap section denotes that the amount of penetrating toner, which is flown from the photoreceptor to the fabric, without staying in the fabric is large.

The following indicates a result of measurement of the dry toner penetration based on the reflection density when the apparatus of FIG. 2 transfers the dry toner to various fabrics.

Specifically, a reflective densitometer of QEA Inc. is used as a densitometer. As shown in Table 2, texture densities, which are reflection densities of fabrics and mounts measured before the toner transfer, and toner densities, which are reflection densities of the fabrics and the mounts after the toner transfer, are obtained. The texture densities are subtracted from the toner densities to calculate net toner-based reflection densities of the fabrics and the mounts, and the densities are added to obtain total densities. Then, proportions of the net reflection densities of the mounts relative to the total densities are calculated to set the proportions as toner transmittances. The solid image is transferred by setting the transfer gap G between the fabric and the intermediate transfer belt to 0 mm and is transferred without pressing. The toner used here is a commercially available black dry pigment toner.

For example, in No. 1 of Table 2, the transmittance of toner=(0.1−0.088)/(1.229+0.100−0.083−0.088)=1.04%.

Table 2 shows characteristics of various untreated polyester fabrics, and Table 3 shows an example of measurement of transmittances of the fabrics. The thickness of each fabric is as shown in Table 3. The fabrics are as follows.

Satin: polyester fabric of Teijin Limited
Tropical: polyester fabric of Unitika Ltd.
Sillook: polyester fabric of Toray Industries Inc.
Amunzen: polyester fabric of Toray Industries Inc.

TABLE 2

| No. | Untreated/ Fabric Type | | | |
|---|---|---|---|---|
| 1 | Satin | Texture | | 5 Harness Satin (Skip 2) |
| | | Fineness (D) | Vertical | 53.7 |
| | | | Horizontal | 80.3 |
| | | Density (cm/fibers) | Vertical | 93.0 |
| | | | Horizontal | 36.0 |
| | | The Number of Twists (cm/T) | Vertical | 0 (No Twist) |
| | | | Horizontal | 0 (No Twist) |
| 2 | Tropical | Texture | | Plain Weave |
| | | Fineness (D) | Vertical | 208.5 |
| | | | Horizontal | 216.3 |
| | | Density (cm/fibers) | Vertical | 25.0 |
| | | | Horizontal | 25.0 |
| | | The Number of Twists (cm/T) | Vertical | Z150 |
| | | | Horizontal | Z150 |
| 3 | Sillook | Texture | | Plain Weave |
| | | Fineness (D) | Vertical | 54.1 |
| | | | Horizontal | 110.0 |
| | | Density (cm/fibers) | Vertical | 63.0 |
| | | | Horizontal | 36.0 |
| | | The Number of Twists (cm/T) | Vertical | 0 (No Twist) |
| | | | Horizontal | 0 (No Twist) |
| 4 | Amunzen | Texture | | Crepe |
| | | Fineness (D) | Vertical | 83.1 |
| | | | Horizontal | 81.8 |
| | | Density (cm/fibers) | Vertical | 46.0 |
| | | | Horizontal | 40.0 |
| | | The Number of Twists (cm/T) | Vertical | Interlace (No Twist) |
| | | | Horizontal | Interlace (No Twist) |

TABLE 3

| No. | Untreated/ Fabric Type | Toner Transmittance (%) | Fabric Thickness (mm) | Reflection Density: On Fabric: Toner Density | Reflection Density: On Fabric: Texture Density | Reflection Density: On Mount: Toner Density | Reflection Density: On Mount: Texture Density | Total Density (Excluding Texture Density) |
|---|---|---|---|---|---|---|---|---|
| 1 | Satin | 1.04 | 0.13 | 1.229 | 0.083 | 0.100 | 0.088 | 1.329 |
| 2 | Tropical | 6.61 | 0.20 | 0.991 | 0.056 | 0.159 | 0.093 | 1.150 |
| 3 | Sillook | 10.39 | 0.15 | 1.034 | 0.065 | 0.166 | 0.054 | 1.200 |
| 4 | Amunzen | 54.11 | 0.32 | 0.451 | 0.065 | 0.550 | 0.094 | 1.001 |

Based on the above, it can be recognized that the transmittance of the toner is about 1% even in satin with a relatively high weave density in which a hard twist yarn is not used.

About 54% of toner is transmitted in amunzen using a hard twist yarn. The penetrated toner does not contribute to the printing, not to mention stains on the conveying belt. Therefore, the cost cannot be ignored.

It is preferable to apply preprocessing of filling the spaces between adjacent yarns constituting the fabric or between fibers constituting the yarns with an inorganic filler in these types of fabrics before the printing by the printing apparatus 100 as in FIG. 2. It is preferable that the preprocessing step fills the gaps at a thickness equivalent to 10 to 100% or 10 to 90% of the thickness of the fabric.

Specifically, for example, a paste including an inorganic filler (powder) and a binder can be applied to the fabric and dried in the preprocessing. Examples of the inorganic filler include silica and alumina. Examples of the binder that can be used include the water-soluble binders described above.

The paste containing the inorganic filler can be prepared by, for example, mixing 11% by weight of silica powder (Senka Corporation, SYLOJET P612), 45% by weight of 13.3% aqueous solution of PVA (The Nippon Synthetic Chemical Industry Co., Ltd., gohsenol N-300), and 44% by weight of water. The paste is applied to the four fabrics by a bar coater or the like and is dried for two minutes at 110° C. Excess solid content is taken off after drying, and the top section of the fabric is exposed. As a result, the gaps are filled at the thickness of the fabric. The extent of the gaps filled relative to the thickness of the fabric can be calculated from the dry weight and the dry specific gravity of the paste applied to the fabric.

Table 4 shows toner transmittances of the fabrics subjected to the preprocessing using such a paste.

TABLE 4

| No. | Preprocessed/ Fabric Type | Toner Transmittance (%) | Fabric Thickness (mm) | Reflection Density: On Fabric: Toner Density | Reflection Density: On Fabric: Texture Density | Reflection Density: On Mount: Toner Density | Reflection Density: On Mount: Texture Density | Total Density (Excluding Texture Density) |
|---|---|---|---|---|---|---|---|---|
| 1 | Satin | 0.47 | 0.13 | 1.138 | 0.049 | 0.095 | 0.089 | 1.233 |
| 2 | Tropical | 0.35 | 0.20 | 1.072 | 0.043 | 0.095 | 0.091 | 1.167 |
| 3 | Sillook | 0.64 | 0.15 | 0.968 | 0.046 | 0.099 | 0.093 | 1.067 |
| 4 | Amunzen | 0.54 | 0.32 | 1.058 | 0.038 | 0.100 | 0.095 | 1.158 |

It can be recognized that the transmittance of the toner is sharply reduced by the preprocessing, and the transmittance is not more than 1% in all fabrics. The inorganic filler, such as silica, has almost no effect on the dye by the dye component included in the dry toner, and the inorganic filler can be easily removed in a subsequent step along with the binder.

In another example, a mixed liquid of 5% by weight of silica powder (Senka Corporation, SYLOJET P612), 45% by weight of 13.3% aqueous solution of PVA (The Nippon Synthetic Chemical Industry Co., Ltd., gohsenol N-300), and 50% by weight of water is applied to the fabric by a bar coater and dried for 2 minutes at 110° C., and excess solid content is taken off after drying to expose the top section of the fabric. As a result, the gaps are filled at the thickness of the fabric. Although there is a similar effect in the example, the transmittance of the toner tends to deteriorate a little.

In the apparatus of FIG. 1, although a case of forming an image by the four-color imaging unit 15 has been described, embodiments of the present invention are not limited to this. A tandem system for sequentially forming images by four monochromatic imaging units may also be implemented.

Second Embodiment

Figure 9:
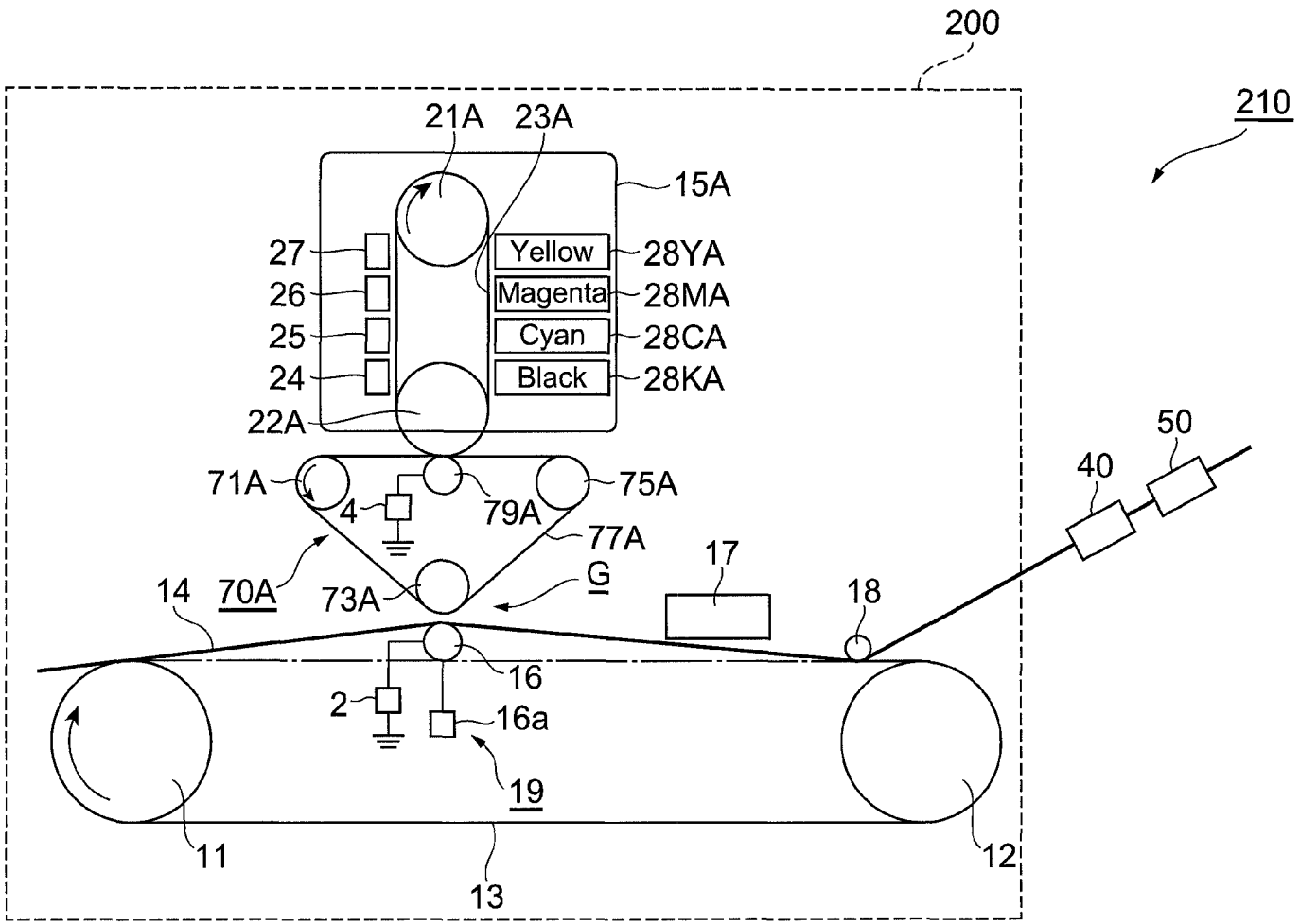
FIG. 9 is a schematic diagram showing a printing apparatus and a dye-printing system according to a second embodiment of the present invention.

Next, a printing apparatus 200 and a dye-printing system 220 according to a second embodiment will be described with reference to FIG. 9. The printing apparatus 200 of FIG. 9 can also perform printing by the four-color collective transfer system. Hereinafter, only the points different from the printing apparatus 100 will be described, and the description of the same parts will not be repeated. The printing apparatus 200 includes a four-color imaging unit (electrostatic holding unit) 15A that forms an image to be transferred to the base material 14 and a transfer unit 70A.

The four-color imaging unit 15A includes pulleys 21A and 22A arranged above and below and a photoreceptor belt 23A wound between the pulleys. Between the pulleys 21A and 22A, the cleaning apparatus 24 that removes an attachment on the photoreceptor belt 23A, the electricity removal apparatus 25 that removes electricity of the photoreceptor belt 23A, a charging apparatus 26 that charges the photoreceptor belt 23A, and an exposure apparatus 27 that forms a latent image on the photoreceptor belt 23A are provided on the photoreceptor belt 23A. On the downstream of the photoreceptor belt 23A, four monochromatic development units 28YA, 28MA, 28CA, and 28KA of yellow, magenta, cyan, and black are arranged in this order along the surface of the photoreceptor belt 23A.

A transfer unit 70A is arranged below the pulley 22A of the imaging unit 15A. The transfer unit 70A includes pulleys 71A, 73A, and 75A as well as an intermediate transfer belt (charged body) 77A that rolls around the pulleys. The transfer unit 70A further includes a primary transfer roller 79A below the pulley 22A through the transfer belt 77A. The high-voltage power supply 4 supplies, to the primary transfer roller 79A, a high voltage for generating a transfer potential opposite to the toner, for transferring the image of the toner formed on the photoreceptor belt 23A to the intermediate transfer belt.

Furthermore, the secondary transfer roller 16 is arranged below the transfer unit 70A through the conveying belt 13 and the base material 14. As in the printing apparatus 100, the secondary transfer roller 16 includes the high-voltage power supply 2 and the transfer gap adjustment apparatus 16*a*. As in the printing apparatus 100, the image formed by the dry toner on the photoreceptor belt 23 can be transferred to the base material 14.

In the printing apparatus 200, a full-color image is formed on the base material 14 as follows.

First, the pulleys 21A and 22A rotate, and the electricity removal apparatus 25 removes the electricity from the surface of the photoreceptor belt 23A. The charging apparatus 26 charges the entire belt in advance. Subsequently, the exposure apparatus 27 forms a predetermined image (monochromatic image corresponding to one of yellow, magenta, cyan, and black) on the photoreceptor belt 24A as a latent image. The development unit of one of the monochromatic development units 28YA, 28MA, 28CA, and 28KA corresponding to the formed latent image is then activated to form a monochromatic image corresponding to the latent image on the photoreceptor belt 23A.

Next, below the pulley 22A, the monochromatic image formed by the monochromatic development unit is transferred to the transfer belt 77A by a transfer electric field applied between the photoreceptor belt 23A and the transfer belt 77A based on the potential of the primary transfer roller 79A of the transfer unit 70A. The monochromatic image formed on the photoreceptor belt 23A is transferred to the transfer belt 77 through rotations of the pulleys 21A and 22A in the imaging unit 15A and the pulleys 71A, 73A, and 75A of the transfer unit 70A. Subsequently, the cleaning apparatus 24 removes an attachment on the photoreceptor belt 23A. Another monochromatic image is formed by a development unit through electricity removal, charging, and exposure, and the image is transferred and superimposed on the transfer belt 77A.

The transfer is repeated to electrostatically provide a full-color image on the transfer belt 77A.

Subsequently, as in the printing apparatus 100 shown in FIG. 2, the image on the transfer belt 77A is flown and transferred to the base material 14 on the conveying belt 13 based on the effects of the secondary transfer roller 16, the high-voltage power supply 2, and the transfer gap adjustment apparatus. After the transfer, as in the printing apparatus 100 shown in FIG. 2, the fixation apparatus 17 provisionally fixes the image on the base material 14.

As in the printing apparatus 100, the dye apparatus (dye unit) 40 and the binder removal apparatus (binder removal unit) 50 are further arranged on the downstream of the printing apparatus 200 configured this way, and the components as a whole constitute the dye-printing system 210.

The embodiment attains the same effects as in the embodiment described above.

Third Embodiment

Figure 10:
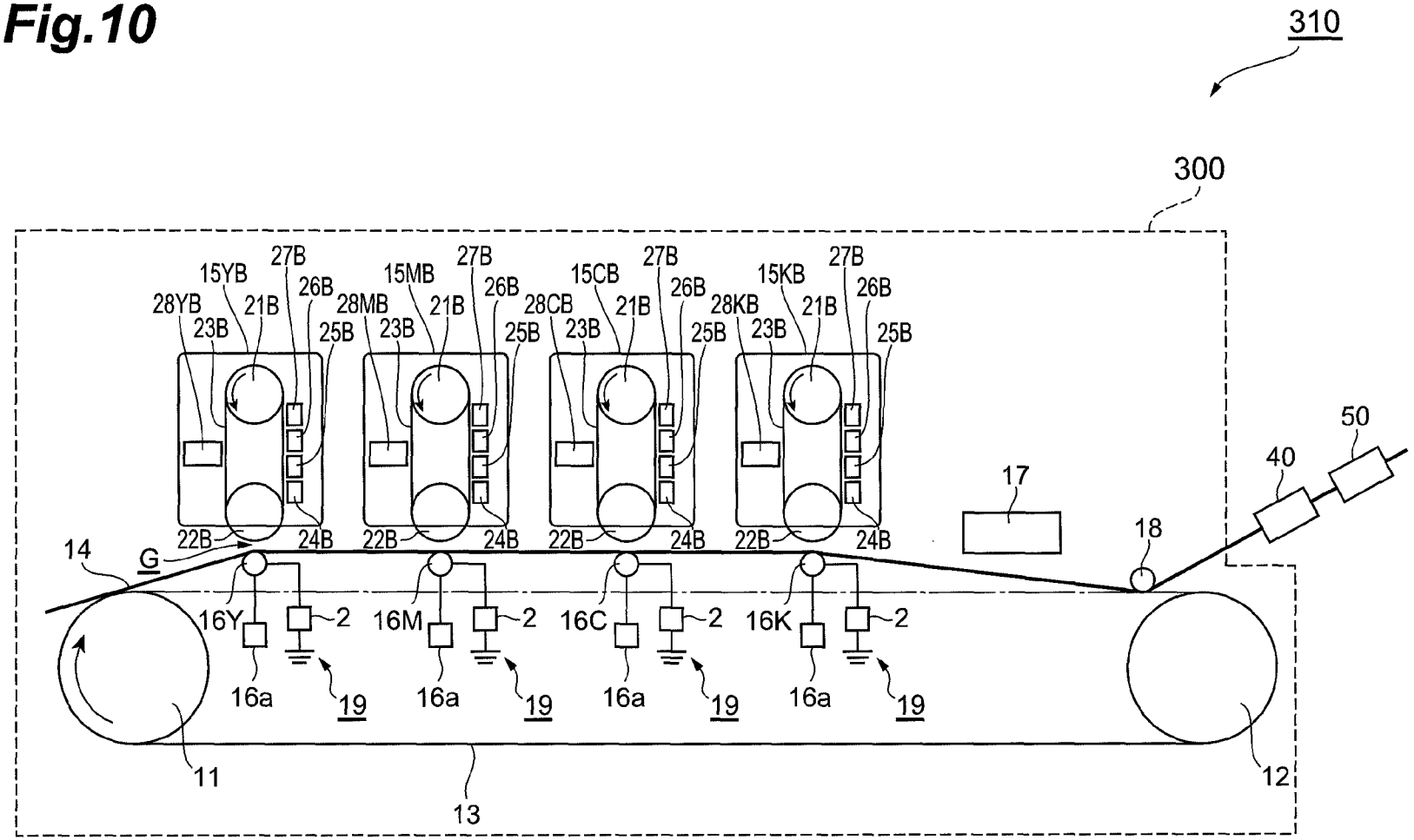
FIG. 10 is a schematic diagram showing a printing apparatus and a dye-printing system according to a third embodiment of the present invention.

FIG. 10 is a schematic diagram showing a printing apparatus 300 and a dye-printing system 310 according to still another third embodiment of the present invention. The printing apparatus 300 of FIG. 10 can also perform dye-printing by the four-color collective transfer system. Hereinafter, only the points different from the printing apparatus 100 of FIG. 2 will be described, and the description of the same parts will not be repeated. In the printing apparatus 300, monochromatic imaging units (electrostatic holding units) 15YB, 15MB, 15CB, and 15KB that form monochromatic images of yellow, magenta, cyan, and black are arranged in tandem on the conveying belt 13.

For example, the monochromatic imaging unit 15YB includes pulleys 21B and 22B arranged above and below and a photoreceptor belt (charged body) 23B wound between the pulleys. Between the pulleys 21B and 22B, a cleaning apparatus 24B that removes an attachment on the photoreceptor belt 23B, an electricity removal apparatus 25B that removes electricity of the photoreceptor belt 23B, a charging apparatus 26B that charges the photoreceptor belt 23B, and an exposure apparatus 27B that forms a latent image on the photoreceptor belt 23B are provided on the photoreceptor belt 23B. A yellow monochromatic development unit 28YB of yellow is arranged on the downstream of the photoreceptor belt 23B.

The monochromatic imaging units 15MB, 15CB, and 15KB of magenta, cyan, and black are constituted in the same way as the monochromatic imaging unit 15YB, except that the colors of the dry toners filled in development units 28MB, 28CB, and 28KB are different.

Furthermore, below the monochromatic imaging units 15YB, 15MB, 15CB, and 15KB, transfer rollers 16Y, 16M, 16C, and 16K are arranged through the conveying belt 13 and the base material 14. The high-voltage power supply 2 for generating a transfer potential with a sign opposite to that of the toner supplies high voltages to the transfer rollers 16Y, 16M, 16C, and 16K. Transfer gap adjustment apparatuses 16*a*Y, 16*a*M, 16*a*C, and 16*a*K are also arranged, which sequentially transfer images formed by the dry toners on the photoreceptor belts in the monochromatic imaging units 15YB, 15MB, 15CB, and 15KB to the base material 14.

The fixation apparatus 17, which is the same as in the printing apparatus 100 shown in FIG. 2, is arranged on the conveying belt 13. The fixation apparatus 17 provisionally fixes the image transferred to the base material 14 as in the printing apparatus 100 shown in FIG. 2.

In the printing apparatus 300, a full-color image is formed on the base material 14 as follows.

First, the pulleys 21B and 22B rotate in the monochromatic imaging units 15YB, 15MB, 15CB, and 15KB. The electricity removal apparatus 25 removes electricity from the surface of the photoreceptor belt 23B, and the charging apparatus 26 charges the entire belt in advance. Subsequently, the exposure apparatus 27 forms a predetermined image (monochromatic image corresponding to one of yellow, magenta, cyan, and black) on the photoreceptor belt 23B as a latent image. Subsequently, the monochromatic development units 28YB, 28MB, 28CB, and 28KB corresponding to the formed latent images are activated to form monochromatic images corresponding to the latent images on the photoreceptor belt 23B.

Next, the monochromatic images formed by the monochromatic development units are transferred to the base material 14 by an electric field generated between the photoreceptor belt 23B and the conveying belt 13 based on the potential of the transfer roller 16Y, 16M, 16C, 16K below the pulley 22B. In this case, the image formation timing can be synchronized in accordance with the transfer positions of the monochromatic development units 28YB, 28MB, 28CB, and 28KB to electrostatically form a desired full-color image on the base material 14 over the conveying belt 13.

As in the printing apparatus 100, the dye apparatus (dye unit) 40 and the binder removal apparatus (binder removal unit) 50 are further arranged on the downstream of the printing apparatus 300 configured this way, and the components as a whole constitute the dye-printing system 310.

The embodiment attains the same effects as in the embodiment described above.

Fourth Embodiment

Figure 11:
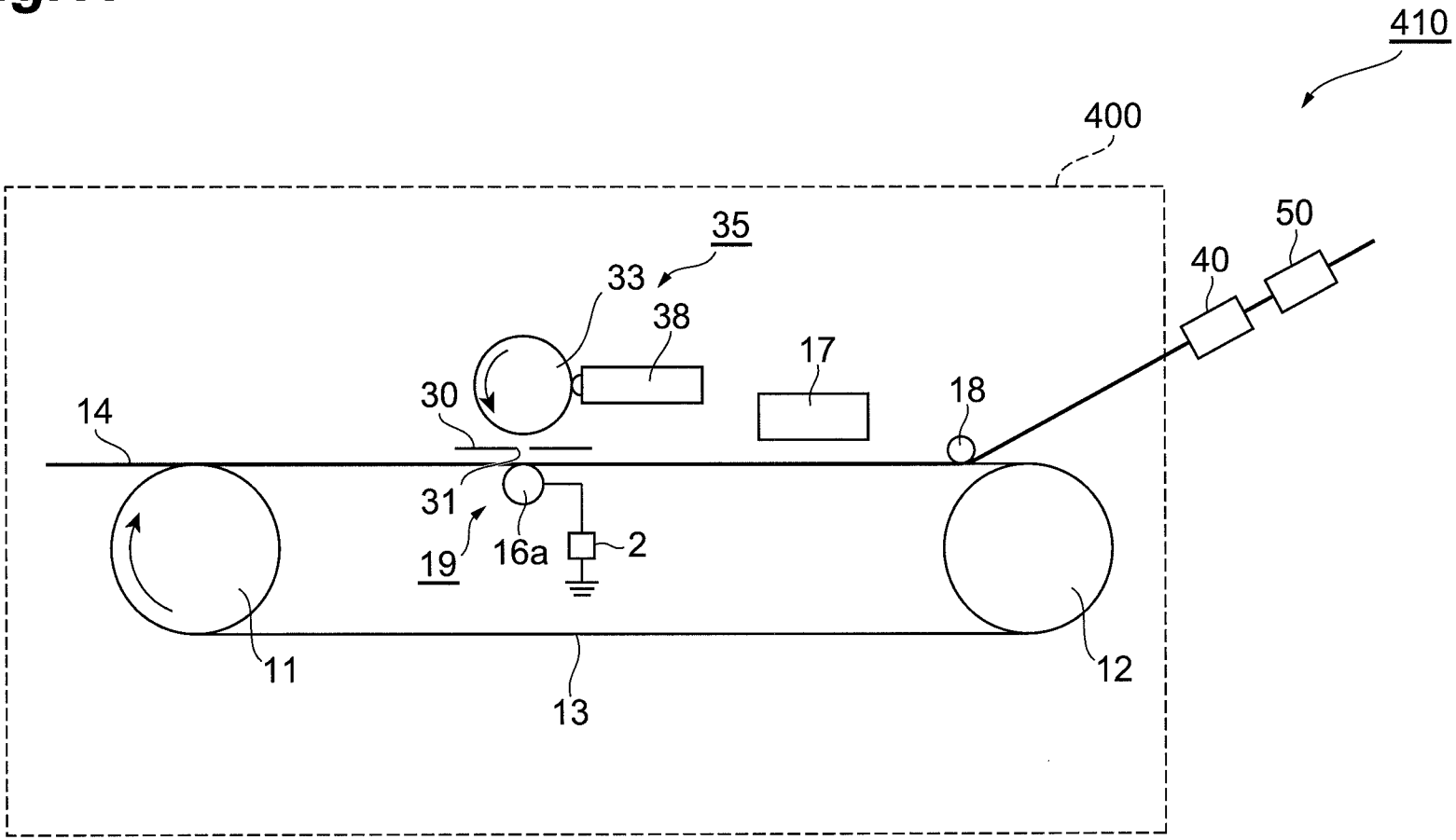
FIG. 11 is a schematic diagram showing a printing apparatus and a dye-printing system according to a fourth embodiment of the present invention.

FIG. 11 is a schematic configuration diagram of the printing apparatus 200 according to another fourth embodiment of the present invention. In the printing apparatuses 100, 200, and 300, methods of forming an arbitrary image on the photoreceptor belt or the transfer belt to transfer the image to the base material, such as a fabric, have been described. In the fourth embodiment, an arbitrary image cannot be formed, and a so-called solid image, in which the entire surface of the base material such as a fabric is monochromatic, is printed and dye-printed.

In the present embodiment, a monochromatic providing unit 35 is arranged in place of the four-color imaging unit 15 in the printing apparatus 100 of FIG. 1. As for the other parts, the same constituent elements as in the printing apparatus 100 are provided, and the same reference numerals are provided to the corresponding constituent elements.

The monochrome providing unit 35 includes a metal toner conveying drum 33 as a charged body, instead of the photoreceptor. Therefore, the charge is uniformly distributed even if the toner conveying drum 33 is charged, and a solid latent image is always formed. A power supply (not shown) that provides a voltage for supporting the toner is connected to the toner conveying drum 33. Furthermore, the monochrome providing unit 35 includes a toner providing apparatus 38 that supplies a toner to the toner conveying drum 33. Below the toner conveying drum 33, a transfer electrode 30 for controlling the toner transfer amount and a power supply (not shown) for providing a transfer voltage to the transfer electrode 30 are arranged. An opening 31 for passing the dry toner is arranged on the transfer electrode 30, and the secondary transfer roller 16 is arranged below the opening 31. The high-voltage power supply 2 and the transfer gap adjustment apparatus 16*a* are arranged on the secondary transfer roller 16.

A voltage is applied (500 to 1000 V) to the toner conveying drum 33, and the toner of the toner providing apparatus 38 is charged with a polarity opposite that of the voltage. Therefore, the toner is attached to the surface of the toner conveying drum 33 and carried to the opening 31 by the rotation of the toner conveying drum 33. A voltage with the same polarity higher than the toner conveying drum 33 is applied (1000 to 2000 V) to the transfer roller 16. If a control voltage is applied (500 to 1500 V) to the transfer electrode 30 under the conditions, the toner is flown to the base material 14 as a recorded medium. The amount of the flying toner is controlled by the voltage of the transfer electrode 30, and the greater the voltage, the greater the amount. Subsequently, as in the apparatus of FIG. 2, the fixation apparatus 17 provisionally fixes the toner on the base material 14. The toner passes through the dye apparatus 40 as well as the binder removal apparatus 50 that removes the binder resin if necessary, and further through a finishing step such as washing, the toner becomes a dye-printed material as a final product.

A case of dyeing by use of a monochromatic dry toner has been described in FIG. 11. However, because the amount of the toner can be controlled according to the method of FIG. 11, YMC three colors can be arranged in tandem to produce a plain dye-printed material of an arbitrary color.

Embodiments of the present invention are not limited to the above embodiments, and various modified modes are possible. For example, although the dry toner particles are provisionally fixed in the above embodiments, embodiments of the present invention can also be carried out even if the particles are permanently fixed by the fixation apparatus 17, such as by pressurizing and heating by a heating roller or the like, if the handle and the like are not problems. In that case, the removal of the binder is not necessary.

The configuration of the transfer unit is not limited to the above description, as long as the dry toner on the charged body can be flown by the electric field to the base material facing the charged body. Furthermore, the configuration of the electric field application unit is not particularly limited, as long as an electric field that can fly the toner particles can be generated.

The configuration of the base material conveying unit is not limited to the conveying belt, either.

According to embodiments of the present invention, an image can be clearly printed and dye-printed on a base material, and embodiments of the present invention can be used in various fields including the dye industry.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE NUMERALS LIST

2 high-voltage power supply (electric field application unit)
11 pulley
12 pulley
13 conveying belt (base material conveying unit)
14 fabric
15, 15A four-color imaging units (electrostatic holding units)
15YB, 15MB, 15CB, 15KB monochromatic imaging units (electrostatic holding units)
16 secondary transfer roller
17 fixation apparatus (fixing unit)
18 peeling roller
19 transfer unit
21 pulley
22 pulley
23 intermediate transfer belt (charged body)
23B photoreceptor belt (charged body)
24 cleaning apparatus
25 electricity removal apparatus
26 charging apparatus
27 exposure apparatus
28Y yellow imaging unit
28M magenta imaging unit
28C cyan imaging unit
28B black imaging unit
29Y primary transfer roller
29M primary transfer roller
29C primary transfer roller
29K primary transfer roller
30 transfer electrode
31 opening
33 toner conveying drum (charged body)
35 monochrome providing unit (electrostatic holding unit)
38 toner providing apparatus
40 dye apparatus (dye unit)
50 binder removal apparatus (binder removal unit)
77A intermediate transfer belt (charged body)
100, 200, 300, 400 printing apparatuses
110, 210, 310, 410 dye-printing systems
G transfer gap (space)

The invention claimed is:

1. A method for producing a printed material comprising:

electrostatically holding at least one type of charged dry toner containing a dye component and a binder resin to a charged body;

transferring the dry toner from the charged body to a base material fixed to a conveying belt; and fixing the dry toner to the base material, wherein in the transferring step, the charged dry toner on the charged body is flown from the charged body to the base material by applying a high voltage to an electrode arranged through the conveying belt and the base material in a state in which a gap is provided between the dry toner on the charged body and the base material to generate an electric field at the gap, wherein the high voltage is not less than 85% of y, and not more than 160% of y, and wherein x [mm] is a distance between the charged body and the electrode, and y=1.45x+1.68 [kV].

2. The method according to claim 1, wherein the base material has projections and recesses on a surface.

3. The method according to claim 1, wherein the base material is a fabric.

4. The method according to claim 3, wherein in the transferring step, the dry toner is arranged between fibers constituting the fabric.

5. The method according to claim 3, wherein a gap between the fibers constituting the fabric provided in the transfer step is filled with an inorganic filler.

6. The method according to claim 1, wherein the charged body is a conductive photoreceptor, and wherein in the electrostatically holding step, an image based on the dry toner is held to the conductive photoreceptor.

7. The method according to claim 1, wherein in the fixing step, the dry toner is provisionally fixed to the base material.

8. A printed material produced by the method according to claim 1.

9. A method for producing a dye-printed material comprising:

the method for producing a printed material according to claim 1; and dyeing the base material by the dye component in the fixed dry toner in the printed material.

10. A dye-printed material produced by the method according to claim 9.

11. A printing apparatus, comprising:

a base material conveying unit that conveys a base material;

an electrostatic holding unit that electrostatically holds, on a charged body, at least one type of charged dry toner containing a dye component and a binder resin;

an electrode arranged through the base material conveying unit and the base material, the electrode providing a gap between the dry toner on the charged body and the base material;

a transfer unit that transfers the dry toner held on the charged body to the base material conveyed by the base material conveying unit, the transfer unit having a high-voltage power supply that applies a high voltage to the electrode to generate an electric field strong enough to fly the charged dry toner on the charged body from the charged body to the base material; and a fixing unit that is arranged on the downstream of the transfer unit on the base material conveying unit and that fixes the transferred dry toner to the base material, wherein the high voltage is not less than 85% of y, and not more than 160% of y, and wherein x [mm] is a distance between the charged body and the electrode, and y=1.45x+1.68 [kV].

12. The printing apparatus according to claim 11, wherein the base material conveying unit conveys the base material that has projections and recesses on a surface.

13. The apparatus according to claim 11, wherein the fixing unit provisionally fixes the transferred dry toner to the base material.

14. A dye-printing system comprising:

the printing apparatus according to claim 11; and a dye unit that is arranged on the downstream of the printing apparatus and that dyes the base material discharged from the printing apparatus by a dye component in the dry toner fixed to the base material.

* * * * *